United States Patent [19]

Mandell

[11] Patent Number: 4,976,649

[45] Date of Patent: Dec. 11, 1990

[54] DECORATIVE BALLOON STRUCTURE

[75] Inventor: Neil Mandell, Yardley, Pa.

[73] Assignee: C. M. Offray & Son, Inc., Chester, N.J.

[21] Appl. No.: 532,883

[22] Filed: Jun. 4, 1990

[51] Int. Cl.[5] ..... A63H 27/10

[52] U.S. Cl. ..... 446/220; 446/222; 428/43; 156/253; 156/308.4; 156/290

[58] Field of Search ..... 446/220, 221, 222, 226; 428/43; 156/308.4, 290, 253

[56] References Cited

U.S. PATENT DOCUMENTS

| | | | |
|---|---|---|---|
| 2,470,990 | 5/1949 | Kennedy | 446/220 |
| 2,724,924 | 11/1955 | Ingram | 446/222 |
| 2,824,407 | 2/1958 | Ebel | 446/222 |
| 4,116,481 | 9/1978 | Raue | 428/43 |
| 4,488,374 | 12/1984 | Elson | 446/220 |
| 4,555,293 | 11/1985 | French | 156/308.4 |
| 4,580,990 | 4/1986 | Avery | 446/220 |

*Primary Examiner*—Richard J. Johnson

*Attorney, Agent, or Firm*—Mark T. Basseches; Paula T. Basseches

[57] ABSTRACT

A balloon structure is comprised of two heat-sealingly connected polymeric sheets forming a gas encompassing chamber and a connected inflation stem and is characterized by a separable integral tether-defining border strip surrounding at least a portion of the chamber, whereby the tether may be separated from the body of the balloon at all but an anchor point to provide a means for restraining the balloon. Optionally, the tether defining strip portions of the sheets may themselves be heat-sealingly connected, selectively to provide a double width tether or a tubular inflatable tether.

9 Claims, 1 Drawing Sheet

DECORATIVE BALLOON STRUCTURE

BACKGROUND OF THE INVENTION

1. Field of the Invention

The present invention is in the field of decorative balloons.

2. The Prior Art

The use of decorative polymeric balloons and particularly polymeric balloons adapted to be filled with helium is well known. Typically such balloons are comprised of a pair of Mylar films heat-sealingly connected along a continuous line defining the balloon body and inflation stem. The stem includes a filling aperture enabling insertion of the stem over the nozzle of a helium dispenser. Typically the exterior of the balloon is coated with a reflective decorative metallic film. A multiplicity of the balloons are shipped flatwise.

For use, the balloon is inflated through the stem and a transverse heat seal formed across the stem to contain the helium filling. Thereafter a string or ribbon is tied to the stem to form a tether.

The operation of tying individual strings or ribbons to the stem represents a time consuming element of the preparation of filled balloons. Since it is not unusual to require a multiplicity of balloons to be filled and supplied in short periods of time, the operation of manually applying tethers has heretofore represented a bottleneck in the procedure, the problem being exacerbated by the fact that filling is often accomplished in gift shops or like small establishments utilizing unskilled labor. Moreover, the tying operation is rendered more difficult by the tendency of the filled balloons to rise, requiring the operator to stabilize the balloons with one hand and knot the tether with the other.

SUMMARY OF THE INVENTION

The present invention may be summarized as directed to a novel balloon structure including an integral tether.

The invention is further directed to a structure of the type described wherein portions of the polymeric materials forming the balloons may be readily separated, either before or after inflation, to define an integral tether.

In accordance with a further embodiment of the invention the tether defining components of the balloon may themselves form an inflatable compartment so as to define, when filled with air, a three dimensional tether.

The structure may be rapidly fabricated in a single operation which simultaneously die cuts the sheet material, forms the seal defining the gas encasing compartment, stem, and tether, and defines a weakened perforation line separating the tether from the balloon body.

It is accordingly an object of the invention to provide a decorative inflatable balloon structure which may be shipped flatwise and having an integral tether.

DETAILED DESCRIPTION OF THE DRAWINGS

Figure 1:
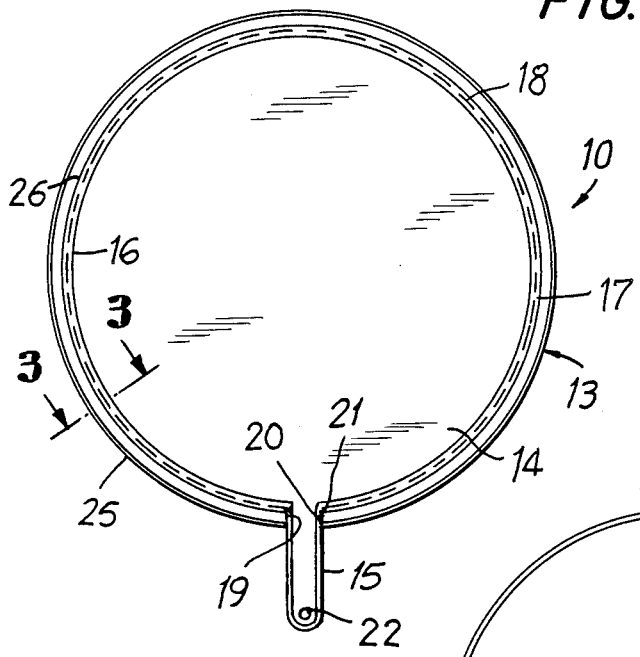
FIG. 1 is a plan view of a balloon structure in accordance with the invention.

There is shown in FIG. 1 a plan view of a balloon structure 10 in accordance with the invention, the structure including a superposed pair of polymeric heat sealable sheets, by way of example Mylar sheets, including upper sheet 11 and lower sheet 12.

As is well knoWn in the art, the structure 10 may preferably be formed to the configuration hereinafter described by a simultaneous die cutting, heat sealing and perforating operation. More specifically, the sheets 11,12 are die cut to define an external margin 13 defining a balloon body portion 14 and an inflation stem 15.

In the fabricating operation there is formed a gas impervious seal line 16 defined by a heat seal connection between the sheets which outlines the inflatable components of the balloon, namely chamber 14 and stem 15.

Externally of the seal line 16 there is formed the circumferential margin 17 (the width of the margin having been exaggerated for purposes of illustration), the margin surrounding the chamber defining portions 14 of the structure.

Within the margin 17 there is formed through the sheets a weakened perforation line 18, enabling all portions of the sheets externally of the perforation line to be readily disconnected from the remainder of the structure. The perforation line 18 preferably surrounds the entirety of the chamber 14.

At one end 19 the perforation line extends transversely across the entirety of the sheets externally of the perforation line 18.

The perforation line 18 ends at an anchor point 20, whereat there is preferably formed a heat seal 21 firmly bonding the portions of the sheets externally of the perforation line to the stem 15.

Figure 2:
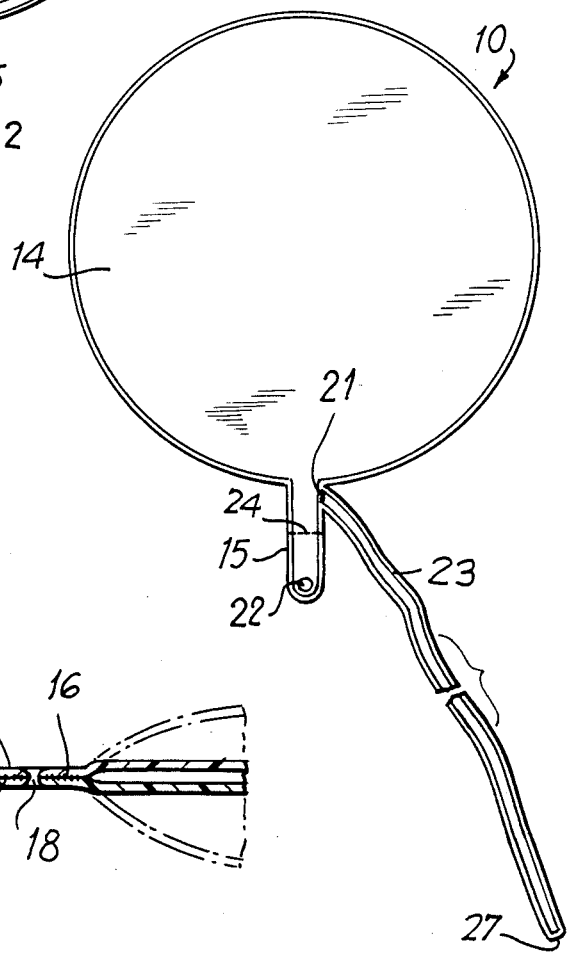
FIG. 2 is a view similar to FIG. 1 showing the components with the tether having been separated to the operative condition thereof.
Figure 3:
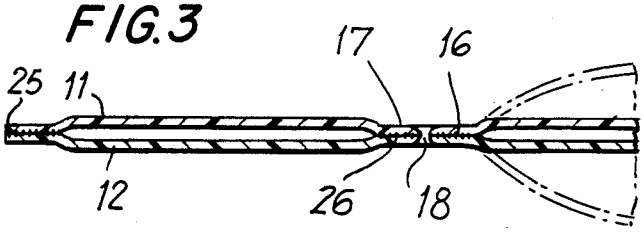
FIG. 3 is a fragmentary transverse section taken on the line 3—3 of FIG. 1.

As will be apparent from a comparison of FIGS. 1 and 2, either before or after inflation of the balloon, i.e. through orifice 22 in the upper sheet 11 defining the stem, the portions of the sheets radially outward of the weakened line 18 may be pulled away from the remainder of the sheets to define a tether 23 fixedly bonded to the stem 15 at anchor seal 21.

The balloon, after filling, is conventionally sealed as by a heat seal 24 across the stem 15.

It will thus be apparent that the structure as thus far described will provide a permanently affixed tether 23 comprised of two discreet strips of the Mylar material.

In accordance with an embodiment of the invention, a further seal line 25 may be formed at the outermost margin of the sheets, whereby the tether 23 will be comprised of unitary tether of double width defined by portions of the upper and lower sheets 11, 12.

In accordance with a further preferred modification, a still further heat seal 26 may be formed immediately outwardly of the perforation line 18 whereby the tether 23 will be comprised of a tubular elongate structure open at its lower end 27 and sealed at its upper end by the anchor seal 21.

In the last mentioned structure, the tubular tether may itself be inflated by the final user and knotted so as to provide a three dimensional tether structure.

As will be apparent from the preceding description there is provided in accordance with the invention a balloon structure having an integral tether whereby the laborious procedure of knottingly connecting a string or ribbon is obviated.

In accordance with known practice, the tether defining components of the structure may be imprinted with a decorative (normally metallic) coloring the same as or contrasting with the remainder of the balloon device.

The options available through minor modifications of the manufacturing process include eliminating longitudinal connections throughout the length of the tether whereby two tether strands are provided; connecting the tether defining components of the sheets along a marginal edge to provide a unitary tether of double width; or forming the tether of two spaced seal lines to define a tubular tether which optionally may be filled to provide a three dimensional tether structure.

Numerous variations in details of construction will occur to those skilled in the art and familiarized with the instant disclosure. Accordingly, the invention is to be broadly construed within the scope of the appended claims.

Having thus described the invention and illustrated its use, what is claimed as new and is desired to be secured by Letters Patent is:

1. In a decorative balloon structure comprising a superposed pair of gas-impervious sheets of heat sealable polymer sealingly connected along a seal line to define a balloon body and an inflation stem extending from said body, the improvement which comprises an integral margin portion of said sheets extending outwardly beyond said seal line and following generally the contours of portions of said seal line surrounding said body, and a weakened tear line formed in said sheets intervening between said seal line and said margin portion, said tear line separating all but an anchor defining end portion of said margin portion from the remainder of said sheets, whereby said margin portion may be separated along said tear line to define a tether connected to said balloon at said anchor portion.

2. A balloon structure in accordance with claim 1 and including a further heat seal in registry with said anchor portion.

3. A balloon structure in accordance with claim 2 wherein said anchor portion is disposed adjacent said inflation stem.

4. A balloon structure in accordance with claim 3 wherein said margin portion extends about substantially the entirety of said body.

5. A balloon structure in accordance with claim 1 and including a second seal line connecting the longitudinal edges of said margin portion.

6. A balloon structure in accordance with claim 1 and including second and third mutually spaced, generally parallel seal lines formed in said margin portion outwardly of said tear line said second and third seal lines forming in said margin portion an elongate inflatable tube member open at the end of said margin portion remote from said anchor portion.

7. In a balloon structure comprising a superposed pair of gas impervious sheets of heat sealable polymer sealingly connected along a seal line to define a curvilinear body portion and an inflation stem, the improvement which comprises an integral arcuate margin strip formed by said sheets and disposed laterally outwardly of said seal line and extending about substantially the entirety of said body portion, heat seal anchor connection means formed at one end of said strip for reenforcing said one end of said strip and linking said strip to the remainder of said sheets, and a weakened tear line interposed between said seal line and said strip throughout substantially the entire extent of said strip except for said heat seal anchor connection means.

8. A balloon structure in accordance with claim 7 wherein the outermost edges of said sheets defining said strip are heat-sealingly connected to each other.

9. Structure in accordance with claim 7 wherein the innermost edges of said sheets defining said strip are heat-sealing connected to each other to form said strip into a tubular structure sealed at said anchor connection means.

* * * * *